US006323830B1

(12) United States Patent
Huang

(10) Patent No.: US 6,323,830 B1
(45) Date of Patent: Nov. 27, 2001

(54) METHOD FOR DRIVING PLASMA DISPLAY PANEL

(75) Inventor: Jih-Fon Huang, Hsinchu (TW)

(73) Assignee: Acer Display Technology, Inc. (TW)

( * ) Notice: Subject to any disclaimer, the term of this patent is extended or adjusted under 35 U.S.C. 154(b) by 0 days.

(21) Appl. No.: 09/443,610

(22) Filed: Nov. 19, 1999

(30) Foreign Application Priority Data

Nov. 20, 1998 (TW) ..... 87119218

(51) Int. Cl.[7] ..... G09G 3/28

(52) U.S. Cl. ..... 345/68; 345/60; 345/61; 345/67; 315/169.1; 315/169.4

(58) Field of Search ..... 345/60, 61, 68, 345/67; 315/169.1, 169.4

(56) References Cited

U.S. PATENT DOCUMENTS 4,772,884 * 9/1988 Weber et al. ..... 345/67
4,924,218 * 5/1990 Weber et al. ..... 345/67
6,236,165 * 5/2001 Ishizuka ..... 315/169.1
6,243,084 * 1/2001 Nagai ..... 345/60

* cited by examiner

*Primary Examiner*—Richard Hjerpe
*Assistant Examiner*—Kevin M. Nguyen

(57) ABSTRACT

This invention relates to a driving method for reducing the dynamic image false contour for display panels, and more particularly, to a driving method that is useful in the display technique of plasma display panels in this method, the erase period of the driving signal is separated and a display electrode and a data electrode are utilized to compose a pair of erasing signals and thus realize the separated erasing signal periods. The present invention further provides a signal process circuit device of the driving method which comprises a plurality of scanning IC's including a plurality of connected transistor switches in order to achieve the division of erasing signal period in the mentioned driving method, It can prevent the abrupt changes of image brightness and the distortion of dynamic image false contour and effectively improve the moving picture quality when the dynamic image is moving. In addition, due to the reduced requirement for the address data memory, the cost on the circuit device can be effectively reduced by using this method, due to the reduced requirement for the address data memory

2 Claims, 11 Drawing Sheets

METHOD FOR DRIVING PLASMA DISPLAY PANEL

FIELD OF THE INVENTION

The present invention relates to a driving method for reducing the dynamic image false contour effect of the plasma display panel. In the present invention, there are several sub-fields included in a frame, and each sub-field comprises: a reset period, a addressing period and a sustaining period. The sustaining period of each sub-field can be further divided into: (1) a first sustaining period, (2) a first erasing period, (3) a second erasing period and (4) a second sustaining period. The first erasing signal is applied onto the sustaining electrode and the scanning electrode of the first display line during the first erasing period, and the second erasing signal is applied onto the sustaining electrode and the scanning electrode of the second display line during the second erasing period. Two separated erasing signals sequentially applied onto two neighboring display lines can reduce the chance to erase extra cells which should be sustained in the second sustaining period.

BACKGROUND OF THE INVENTION

Recently, due to the fast development in electro-optic techniques, the related studies and techniques of plasma display panels (to be abbreviated as PDP here below) have been developed rapidly and suitable for multimedia applications. The advantages of PDP, in contrast to liquid crystal displays now in use, include better moving picture quality and image display characteristics. In addition, the thickness of a PDP is much thinner than that of a conventional cathode ray tube (CRT) television set. The PDP thus catches the eyes of scientists and researchers and have become a popular field of research. We believe that PDP will soon become popular as a home entertainment equipment to replace the traditional display devices.

In general, a high resolution of color PDP with 1028×1024 pixels (SXGA) requires profound techniques of manufacturing process in order to fabricate the fine-pitched barrier ribs and to produce the luminescent materials (such as phosphor) that are essential for PDP fabrication. Furthermore, a high speed driving method is required to activate the pulses and drive the high resolution picture. However, the dynamic false contour of the image appears when the conventional driving method is used in dynamic image display. In other words, when the dynamic image is moving, the abrupt changes of image brightness and the distortion of the image contour take place in some regions of the display, due to the fixed sequence of the sub-field signals in the prior art.

In the prior art, the accumulated brightness level is determined by a plurality of sub-fields which have the sustaining periods of different time duration. However, when the video image is displayed on the PDP driven by the conventional manner with fixed order of time ratio sequence, the abrupt changes of image brightness level will cause the distortion and error as so called "dynamic image false contour" effect.

In order to reduce the "dynamic image false contour" effect, one prior art is shown on the FIG. 1A and FIG. 1B. The FIG. 1A is a schematic diagram illustrating the conventional example of display cells in the prior art. FIG. 1B is a timing diagram illustrating the timing of signal sequences related to the display cells in FIG. 1A. In FIG. 1A, X's and Y's denote the cell display signals in the display matrix and also play the roles of display electrodes. X's and Y's can both be grouped into odd electrodes and even electrodes. FIG. 1B is a timing diagram illustrating the timing of signal sequences in accordance with the X's and Y's electrodes in FIG. 1A, wherein, sequence X includes a rest period, an addressing period, a sustaining period which comprises an erasing period; similarly, sequence Y also includes a reset period, an addressing period, a sustaining period which also comprises an erasing period. Afterwards, sequence Y succeeds with a sustaining period in which sequence Y differs and is complementary with sequence X. In this conventional method, however, signals X's can be even or odd, but they are all erased simultaneously during one erasing period in sequence X. This erasing method will lead to the heavy loss of wall charge accumulated in the Y cells during the single erasing period, then the Y cells can not be maintained in light emission status during the second sustaining period.

BRIEF DESCRIPTION OF THE INVENTION

In order to overcome the problems that have been previously discussed above, the present invention has been proposed and relates to a driving method for reducing the dynamic image false contour for display panels, and more particularly, to a driving method that is useful in the display technique of plasma display panels and can prevent the abrupt changes of image brightness and the distortion of dynamic image false contour and effectively improve the moving picture quality.

Accordingly, it is the main object of the present invention to provide a driving method for reducing the dynamic image false contour for display panels that can prevent the abrupt changes of image brightness and the distortion of dynamic image false contour and effectively improve the moving picture quality.

In addition, it is another object of the present invention to provide a signal process circuit device of the driving method for reducing the dynamic image false contour for display panels that can prevent the abrupt changes of image brightness and the distortion of dynamic image false contour and effectively improve the moving picture quality.

To accomplish the foregoing objects, the present invention provides a driving method in which the erasing period of the sustaining period of the image sequence is separated into an odd erasing period and an even erasing period in order to completely execute the operation during the erasing period. In other words, the driving signal of the dynamic image display utilizes the dual erasing period method to completely execute the erase operation, prevent the dynamic image distortion and achieve better moving picture quality.

It is preferable that the odd erasing period or the even erasing period of the dual erasing period can be realized by using a scanning electrode Y and a data electrode D to compose a pair of erasing signals.

It is preferable that the odd erasing period of the sustaining period comprises a first erasing signal which is realized by using an odd scanning electrode $Y_{odd}$ and an odd data electrode $D_{odd}$ to compose a pair of erasing signals; the even erase period comprises a second erasing signal which is realized by using an even display electrode $Y_{even}$ and an even data electrode $D_{even}$ to compose a pair of erasing signals. In such a manner, the erasing period and the even erasing period can be realized to complete the erasing image signal to effectively reduce the dynamic image contour of the display panels during the sustaining period.

It is preferable that the first erasing signal which is realized by using an odd scanning electrode $Y_{odd}$ and an even data electrode $D_{even}$ to compose a pair of erasing signals and the second erasing signal which is realized by using an even scanning electrode $Y_{even}$ and an odd data electrode $D_{odd}$ to compose a pair of erasing signals can be used to reduce the dynamic image false contour of the display panels.

In the meantime, the present invention further provides a signal process circuit device of the driving method which comprises a plurality of scanning IC's including a plurality of connected transistor switches used to generate a plurality of scanning electrode signals Y's; wherein the output of the plurality of scanning IC's is connected in parallel with an inverter circuit composed of a plurality of transistors.

It is preferable that the plurality of transistors switches connected by the plurality of scanning IC's can be categorized into IC's for scanning odd drivers and IC's for scanning even drivers.

It is preferable that the signal process circuit device of the driving method further comprises a plurality of data IC's which is used to receive different addressing signals and then generate different plurality of data electrode signals.

It is preferable that the mentioned plurality of scanning IC's compose the bottom structure in a display panel device, and the display electrodes X's and Y's compose the upper structure in a display panel device.

Furthermore, concerning the timing signals of the mentioned display electrodes X's and Y's and the data electrodes D's, the interval between the nth and the m-th sustain periods includes two erasing signal period, wherein, the discussed erasing period is used to eliminate the wall charge formed during the Nth sustain period.

BRIEF DESCRIPTION OF THE DRAWINGS

The object spirit and advantages of the present invention will be readily understood by the accompanying drawings and detailed descriptions.

DETAILED DESCRIPTION OF THE INVENTION

Hereinafter, preferred embodiment of the present invention will be described in detail with reference to the accompanying drawings.

The present invention relates to a driving method for a plasma display panel, the driving method can reduce the "dynamic image false contour" effect of the plasma display panel. In the present invention, there are several sub-fields included in a frame, and each sub-field comprises: a reset period, a addressing period and a sustaining period. The sustaining period of the sub-field can be further divided into: (1) first sustaining period, (2) first erasing period, (3) second erasing period and (4second sustaining period. The first erasing signal is applied onto the first display line during the first erasing period, and the second erasing signal is applied onto the second display line during the second erasing period. Two separated erasing signals sequentially applied onto two neighboring display lines can reduce the chance to erase extra cells which should be sustained in the second sustaining period.

Figure 1B:
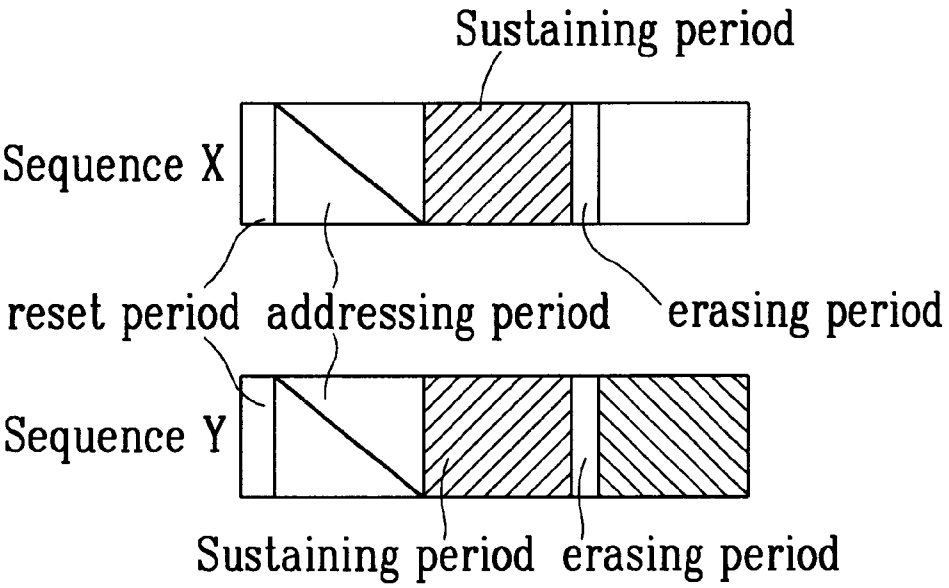
FIG. 1B is a timing diagram illustrating the timing of signal sequences related to the display cells in a conventional PDP in accordance with the prior art.
Figure 1A:
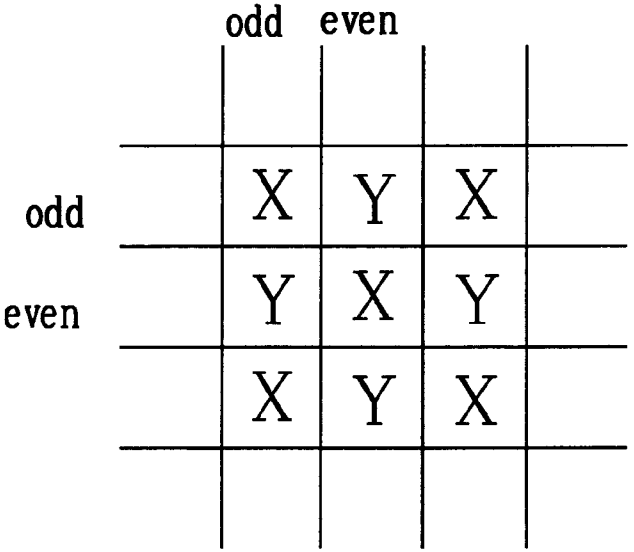
FIG. 1A is a schematic diagram illustrating the display cells in a conventional plasma display panel (PDP) in accordance with the prior art.
Figure 2B:
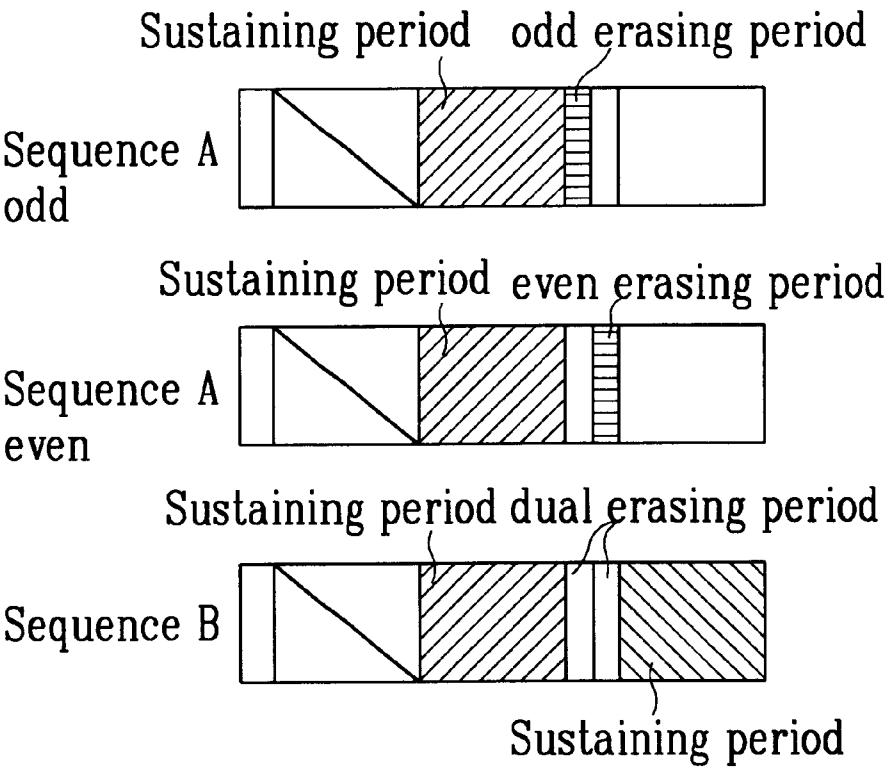
FIG. 2B is a timing diagram illustrating the timing of signal sequences related to the display cells in accordance with the embodiment of the present invention.
Figure 2A:
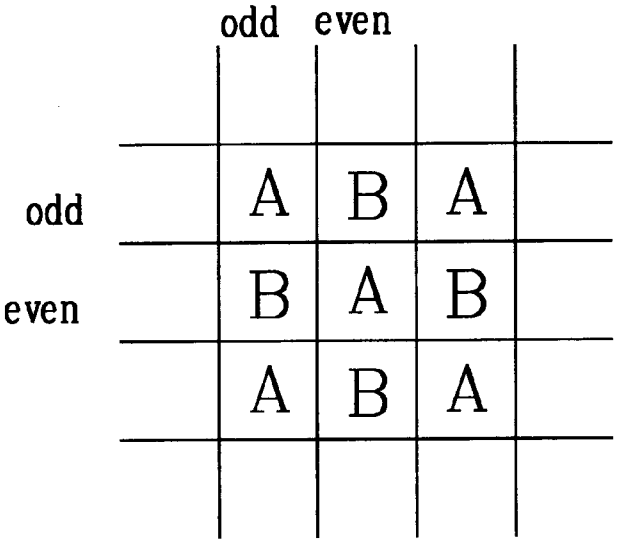
FIG. 2A is a schematic diagram illustrating the display cells in accordance with the embodiment of the present invention.

First of all, please refer to FIG. 2A and FIG. 2B. FIG. 2A is a schematic diagram illustrating the display cells of the PDP arranged and divided in two groups in the present invention. The associated FIG. 2B is a timing diagram illustrating the timing of signal sequences related to the display cells of the PDP in accordance with the embodiment of the present invention. As shown in FIG. 2A, the horizontal display lines (defined by the first and second electrodes) are sequentially numbered as either an odd-numbered display line or an even-numbered display line (from top to bottom). Similarly, the vertical data electrodes (third electrodes) are also sequentially numbered as either an odd-numbered data electrode or an even-numbered data electrode (from left to right).

The display cells of the plasma display are divided into two sets: A-set cells and B-set cells. The A set cells are further divided into two groups: (1) the first group of A-set cells comprising the cells defined by the odd-numbered display lines and the odd-numbered date electrodes, and (2) the second group of A-set cells comprising the cells defined by the even-numbered display lines and the even-numbered data electrodes.

The associated FIG. 2B shows the timing of signal sequences related to the display cells, (1) the odd erasing period corresponding to the first group of A-set cells and (2) the even erasing period corresponding to the second group of A-set cells constitute a dual erasing period in a sustaining period. Similarly, the B-set cells also includes a dual erasing period. Consequently, the present invention provides a new driving method in which the erasing period of the image sequence in the sustaining period of a plasma display panel is separated into an odd erasing period and an even erasing period. Therefore, the wall charge left in the B-set cells will not be seriously removed during executing the erasing operation of the A-set cells, and the B-set cells can be maintained in light emission status during the second sustaining period.

Figure 3:
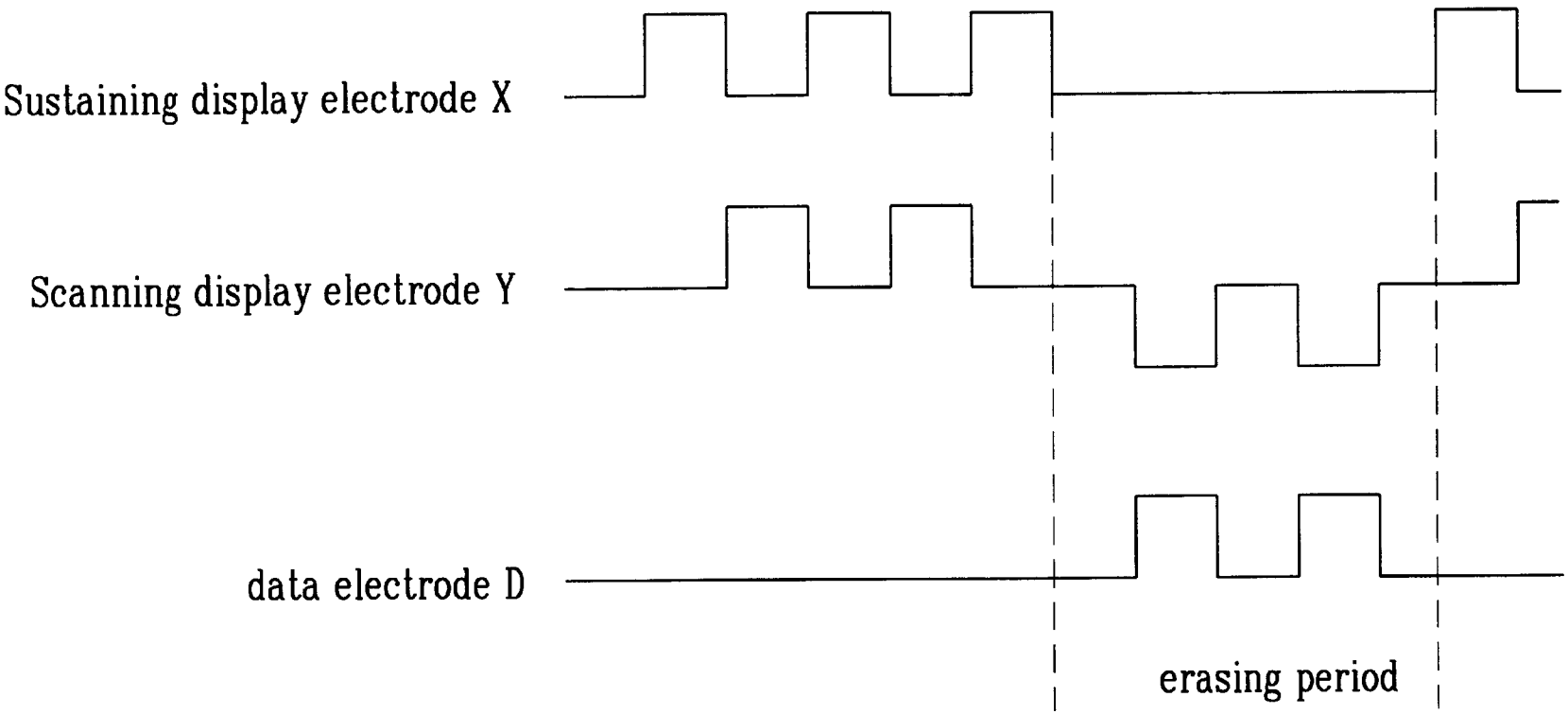
FIG. 3 is a timing diagram illustrating the driving signal sequences of the scanning electrode Y, the data electrode D and the sustaining electrode X in accordance with the embodiment of the present invention.

Please refer to FIG. 3, which is a simplified timing diagram illustrating the basic driving signal for the scanning electrode Y, the data electrode D and the sustaining electrode X in accordance with the embodiment of the present invention. The sustaining signals should be alternatively applied onto the sustaining electrode X and the scanning electrode Y. The erasing signal can be applied between the data electrode D and either one of the scanning electrode Y or the sustaining electrode X.

Figure 4:
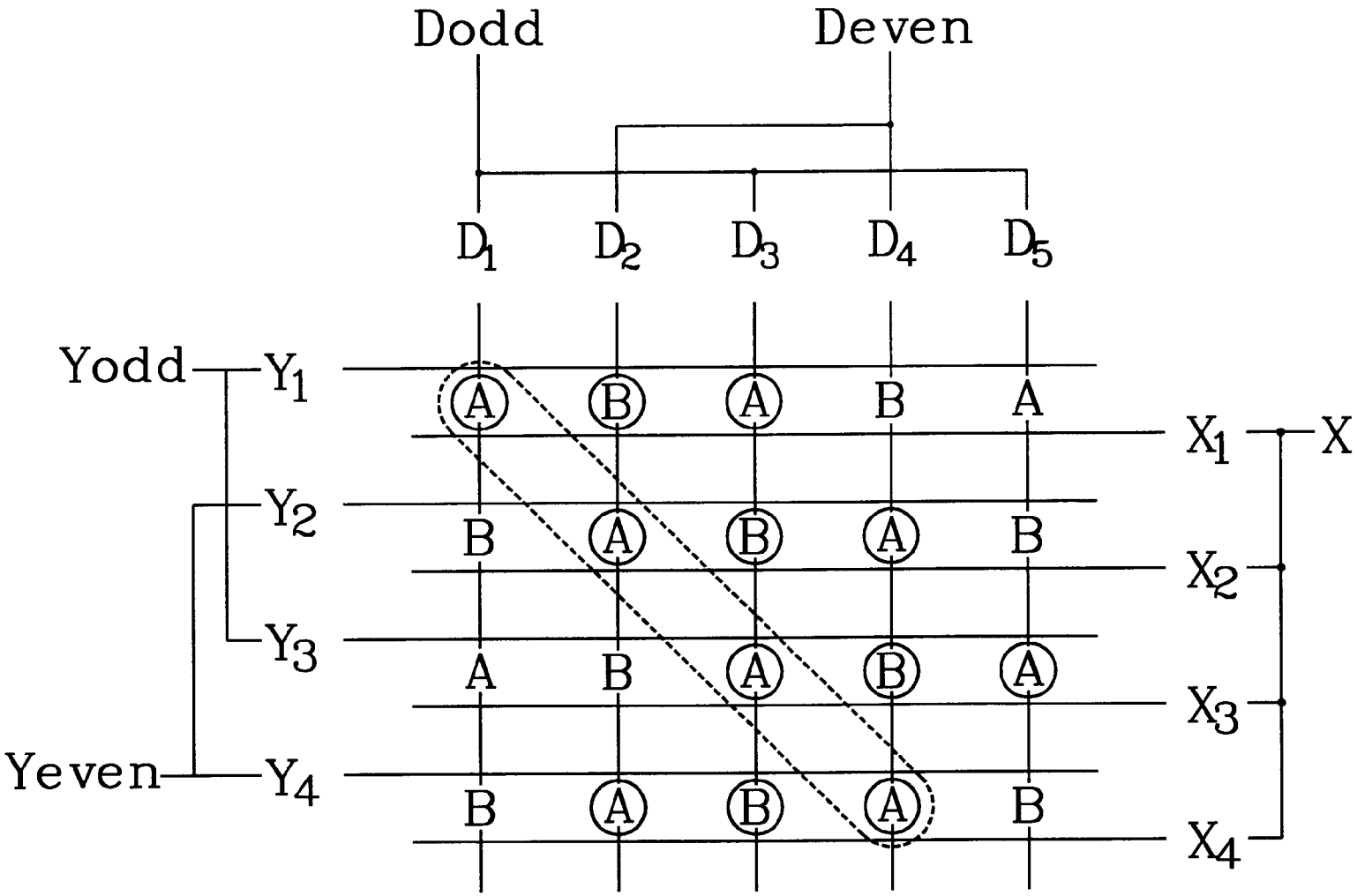
FIG. 4 is a more detailed schematic diagram than FIG. 2A illustrating the display cells in accordance with the embodiment of the present invention.

The FIG. 4 is a more detailed schematic diagram of the FIG. 2A to illustrate the arrangement of related electrodes more clearly. As shown in FIG. 4, $Y_{odd}$ denotes the odd-numbered scanning electrodes of the plasma display panel and $Y_{even}$ denotes the even-numbered scanning electrodes of the plasma display panel; in addition, the data electrodes D's can also be odd-numbered data electrodes $D_{odd}$ or even-numbered data electrodes $D_{even}$. Similarly, the sustaining electrodes X's can be grouped into odd-numbered sustaining electrodes $X_{odd}$ and even-numbered sustaining electrodes $X_{even}$.

Moreover, as shown in FIG. 4, each "A" denotes a display cell of the A-set cells of the plasma display panel; similarly, each "B" denotes a display cell of the B-set cells of the plasma display panel. Furthermore, the circle around each cell indicates the cell is in light emission status. When the erasing operation is executed during the sustaining period, the wall charges of the corresponding circled display cells will be reduced. Accordingly, the embodiment of the present invention provides a new driving method for the plasma display in which a dual erasing period is utilized to effectively eliminate the wall charges of the selected display cells, but has no effect on those unselected display cells that have been circled in the matrix.

On the other hand, as shown in FIG. 4, the display electrodes X's and Y's disposed on the front substrate of a PDP, and the date electrodes D's disposed on the rear substrate of a PDP. Furthermore, referring to FIG. 4, the embodiment of the present invention only uses $Y_1$, $Y_2$, $Y_3$, $Y_4$ and $X_1$, $X_2$, $X_3$, $X_4$ and $D_1$, $D_2$, $D_3$, $D_4$,$D_5$ for description, the users who are skilled in this art, however, can enlarge the circuit device according to the individual needs.

Figure 5:
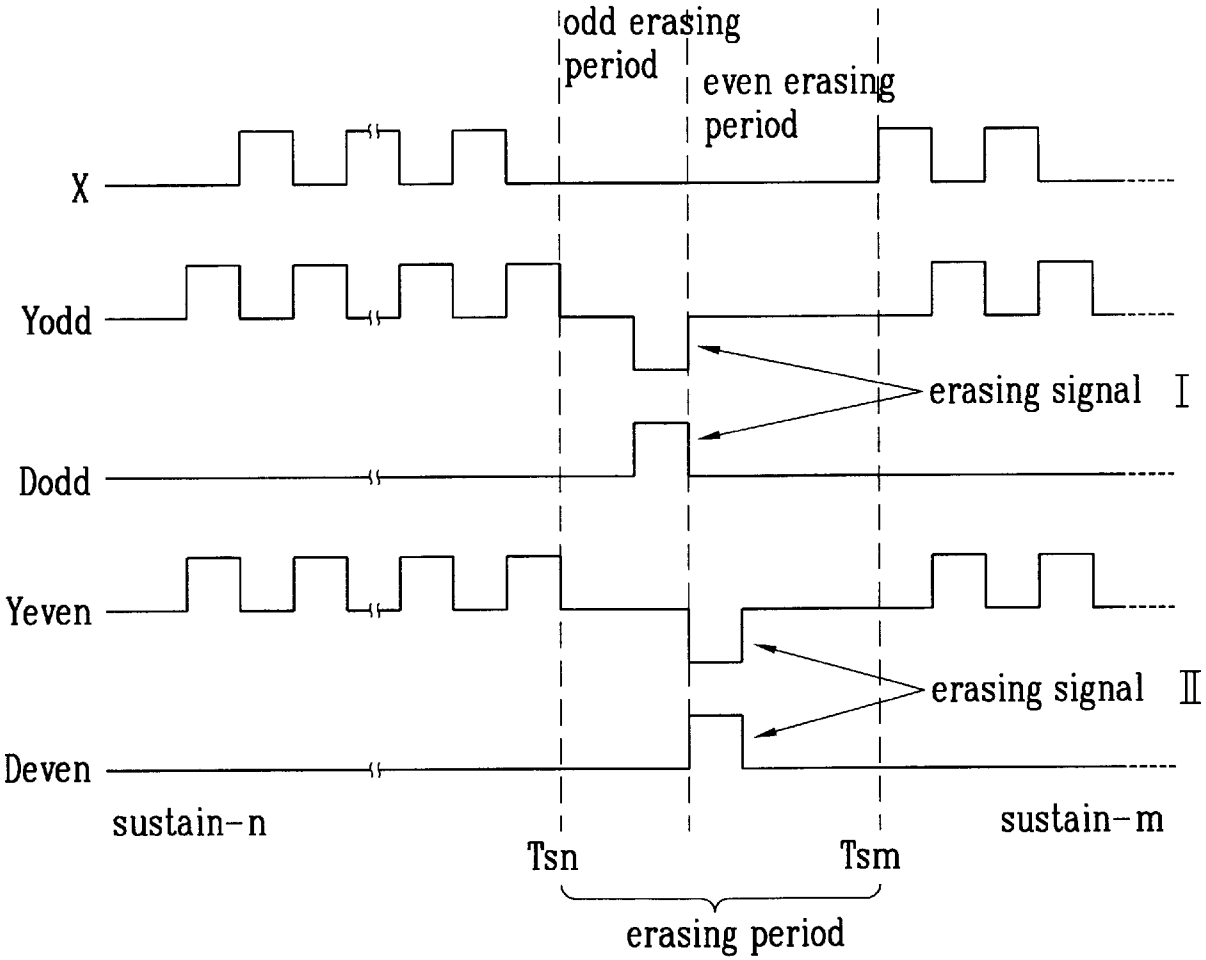
FIG. 5 is a timing diagram illustrating the driving signal sequences of the first erasing signal and the second erasing signal during the sustaining period in accordance with the present invention.

Please refer to FIG. 5, which is a timing diagram illustrating the driving signal sequences of the first erasing signal and the second erasing signal for the A-set cells during the sustaining period in accordance with the present invention. As shown in the drawing, the timing diagram of a sustaining period can be divided into three periods, namely, a first sustaining period (sustain-n), an erasing period, and a second sustaining period (sustain-m). The erasing period can be further divided into an odd erasing period and an even erasing period. The odd erasing period comprises a first erasing signal which is realized by using an odd scanning electrode $Y_{odd}$ and an odd data electrode $D_{odd}$ to constitute a pair of erasing signals. On the other hand, the even erasing period comprises a second erasing signal which is, as shown in the figure, realized by using an even scanning electrode $Y_{even}$ and an even data electrode $D_{even}$ to constitute a pair of erasing signals. In such a manner, the embodiment of the present invention provides a new driving method of the plasma display in which the first erasing signal and the second erasing signal can be sequentially applied to complete the erasing image signal during the sustaining period to effectively reduce the dynamic image false contour effect of the plasma display panels.

Figure 6:
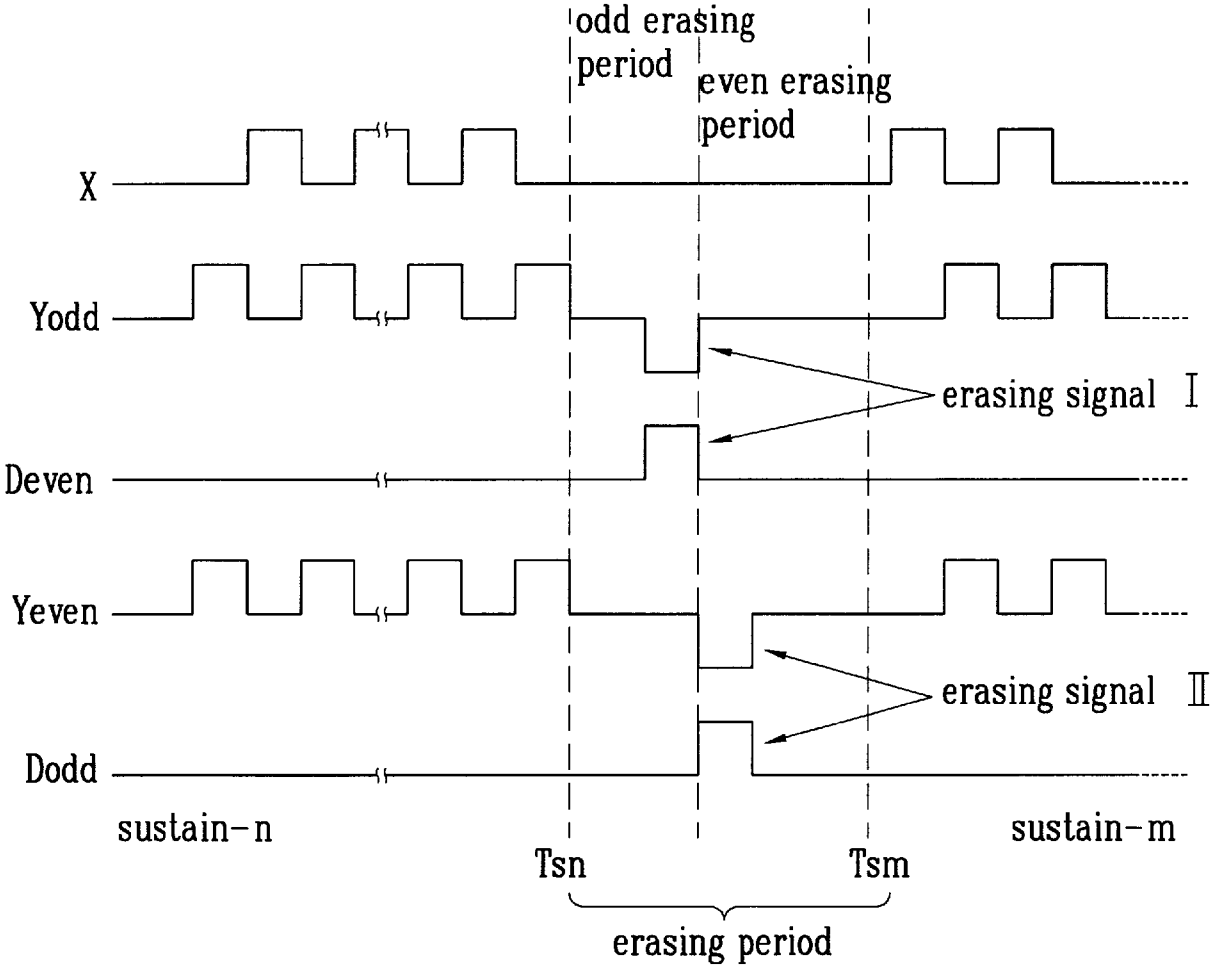
FIG. 6 is a timing diagram with exchanged odd/even sequence corresponding with FIG. 5 in accordance with the present invention.

FIG. 6 is a timing diagram with the reversed odd/even sequence of the FIG. 5 to generate the erase signals for the B-set cells in accordance with the present invention. In other words, as shown in FIG. 6, the first erasing signal is realized by using an odd scanning electrode $Y_{odd}$ and an even data electrode $D_{even}$ to constitute a pair of erasing signals, and the second erasing signal is realized by using an even scanning electrode $Y_{even}$ and an odd data electrode $D_{odd}$ to constitute a pair of erasing signals. In such a manner, the embodiment of the present invention provides a new driving method of the plasma display in which the dual erasing period includes different erasing signals.

Figure 7:
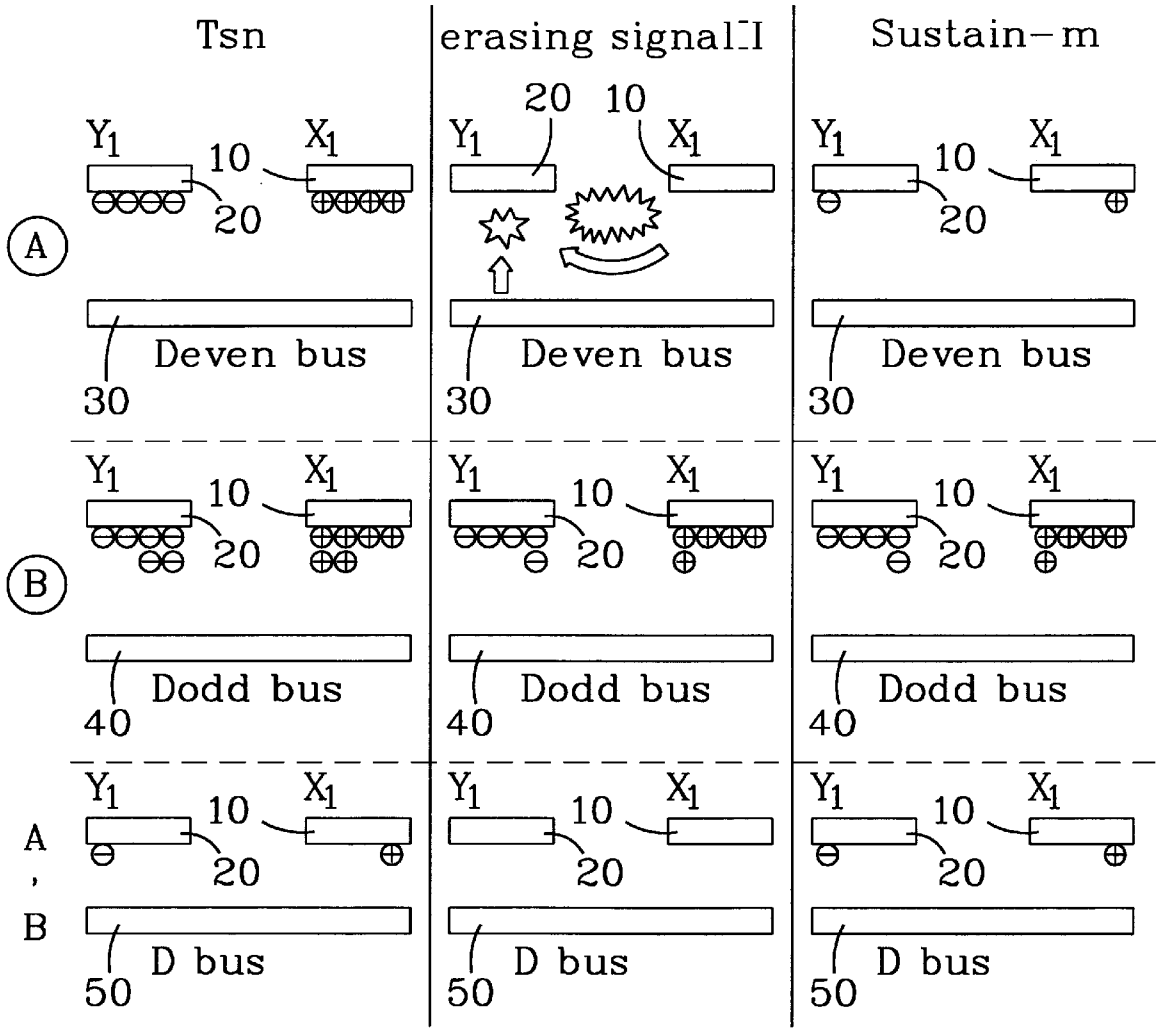
FIG. 7 is a schematic diagram illustrating the wall charge distribution model of the new driving method in accordance with the present invention.

Please refer to FIG. 7, which is a schematic diagram illustrating the wall charge distribution model of the new driving method in accordance with the present invention, in comparison with FIG. 4, which is a detailed schematic diagram illustrating the display cells of the plasma display in accordance with the present invention. The structural segments and the generation of positive or negative charges determine the display cell to be in the lighting state or the extinguishing state. In order to give a concise description of the operation of the display cell, only odd display electrodes $X_1$, $Y_1$, etc. and data electrodes $D_{odd}$, $D_{even}$ are considered. In the same manner, users may further comprehend the operation of the erasing period of other display electrodes according to the need in practical use. In addition, FIG. 7 relates to the wall charge distribution model when the display cell is lighting or extinguishing, Wherein, the circled B denotes the second cell that is lighting. $X_1$ and $Y_1$ denote the display electrodes and compose the upper electrodes, and $D_{odd}$ denotes the data electrode and composes the bottom electrode.

As shown in FIG. 7, the circled display cell "A" is in light emission status during the nth sustaining period ($T_{sn}$, or sustain-n), in which the negative charge is formed on $Y_1$ and the positive charge is formed on $X_1$. Then, as the circled display cell "A" enters the first erasing period (erasing signal I), the first erasing signal which is realized by using the odd display electrode S1, $Y_1$ and the even data electrode $D_{even}$ to eliminate the wall charges (both positive and negative) generated and left from the previous period. Afterwards, as the display cell "A", enters the m-th sustaining period (sustain-m), only little wall charge is formed on the odd display electrodes $X_1$ and $Y_1$, thus the display cell in extinguishing.

On the other hand, as shown in FIG. 7, the circled display cell "B" is composed of an odd data electrode $D_{odd}$ and odd display electrodes $X_1$ and $Y_1$. The circled display cell "B" is in light emission status during the n-th sustain period ($T_{sn}$), in which the negative charge is formed on $Y_1$ and the positive charge is formed on $X_1$. Then, as the circled display cell "B" enters the first erase period (erasing signal I), the first erasing signal is applied onto the odd display electrodes X1, $Y_1$ and the even data electrode $D_{even}$. The even data electrode $D_{even}$ does not affect the circled display cell "B". In other words, the charges (both positive and negative) generated in the previous period still remain on the odd display electrodes $X_1$and $Y_1$. Similarly, as the display cell "B" enters the m-th sustain period (Sustain-m), there is enough wall charge left on the odd display electrodes $X_1$ and $Y_1$, therefore the display can be maintained in light emission status during the second sustaining period.

On the contrary, the non=lighting display cells, non-circled A and non-circled B, almost have no charge formed on the display electrodes during the n-th sustain period ($T_{sm}$), the first erase period (erasing signal I) and the m-th sustain period (Sustain-m).

Accordingly, from the above description accompanied with FIG. 7, it is obvious that the erasing signal is used to "erase" the wall charge formed in each display cells. Therefore, there exist certain relations between the erasing voltage $V_{er}$, wall charge voltage $V_{wall}$, data voltage $V_D$, and the firing voltage $V_{firing\text{-}YD}$ between the display electrode and data electrode. To erase the wall charge in a cell, the sum of "the erasing voltage $V_{er}$, the wall charge voltage $V_{wall}$, and the data voltage $V_D$" is larger than or equal to the firing voltage $V_{firing\text{-}YD}$, which can be expressed as ($V_{er}+V_{wall}>=V_{firing\text{-}YD}$).

Figure 8:
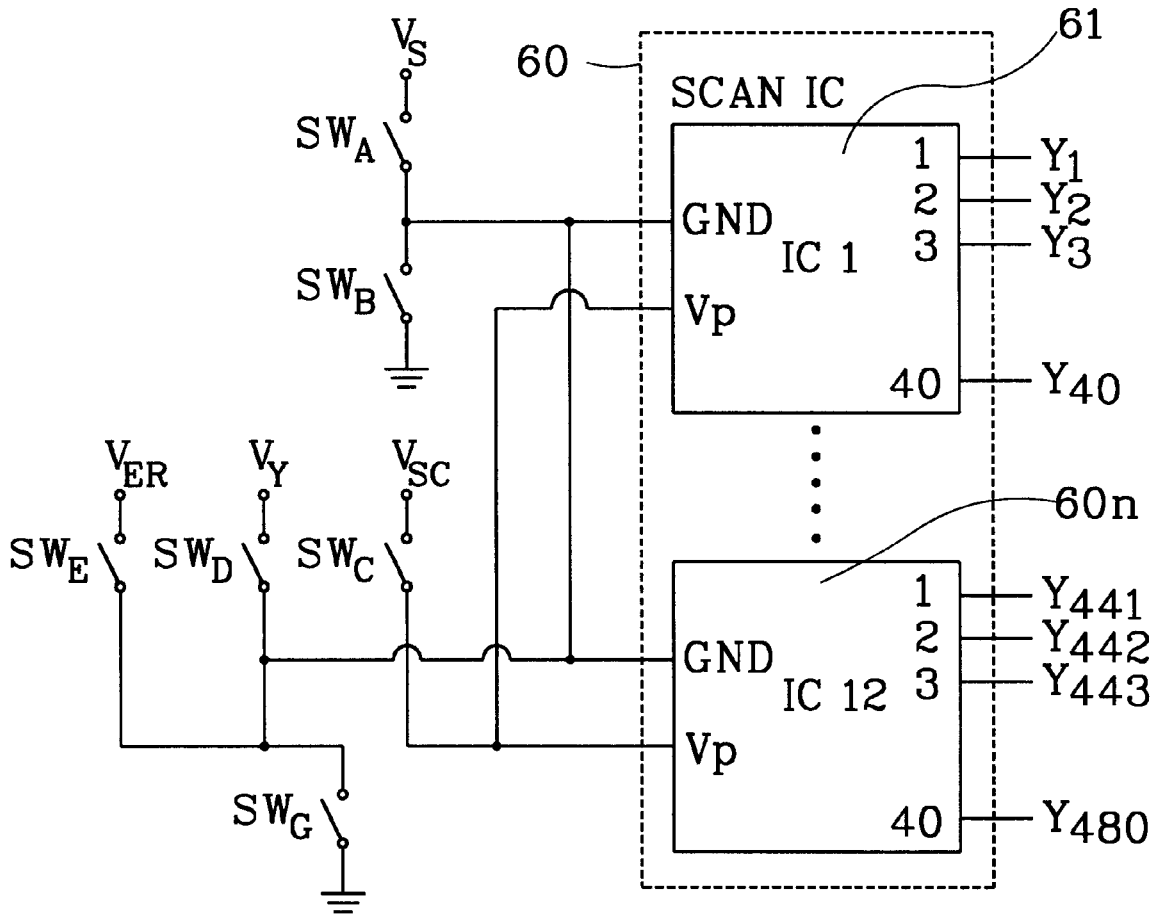
FIG. 8 is a schematic block diagram illustrating a circuit device of scanning IC's in accordance with the present invention.

Please refer to FIG. 8, which is a schematic block diagram illustrating a circuit device of scanning IC's in accordance with the present invention. As shown in the drawing, a circuit device of the plurality of scanning IC's 60 of the embodiment of the present invention is presented. In the present invention, the circuit device comprising twelve scanning IC's as an example. It is composed of scanning IC's from the first one (labeled 61) to the twelfth one (labeled 60*n*). Each scanning IC from 61 to 60*n* comprises forty display electrodes Y's. Thus, the whole circuit device of scanning IC's provides four hundred and eighty output terminals from $Y_1$ to Y480, which are sufficient in practical applications. In addition, the circuit device of scanning IC's 60 is connected to two transistor switches $SW_A$ and $SW_B$ for selecting or enabling. The circuit device of scanning IC's 60 is further connected to a plurality of transistor switches $SW_E$,$SW_D$, and $SW_C$ were associated with another transistor switch $SW_G$ to control the grounding operation of each scanning IC from 61 to 60*n*. In this manner, the output waveforms of display electrodes Y's can be obtained, and the waveforms of the previously discussed erasing signals can thus be generated. Since the first erasing signal and the second erasing signal are determined by the composition of an odd or even display electrode $Y_{odd}/Y_{even}$ and an odd or even data electrode $D_{odd}/D_{even}$, the erasing signals can be realized from the operation of the circuit device as shown in FIG. 8.

Figure 9:
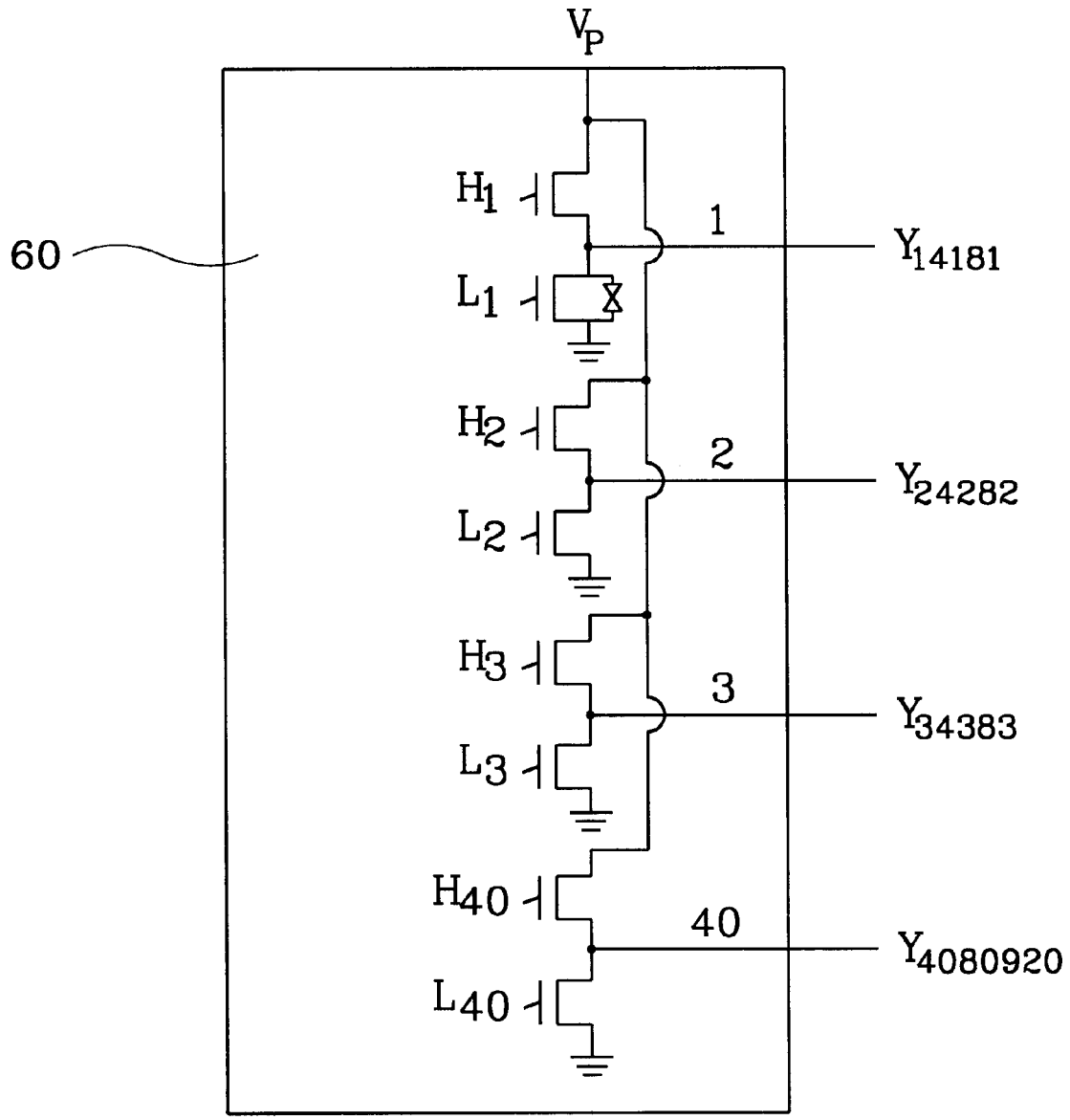
FIG. 9 is a schematic layout of a circuit device of scanning IC's in accordance with the present invention.

The generation of a negative-valued erasing signal is owing to the layout of the circuit device of scanning IC's 60, in which the grounding terminal GND provides an erasing voltage $V_{er}$. In addition, when the transistor switch on the low voltage side of the odd line display electrode is turned on before the first erasing signal arrives, the transistor switch is then enabled, and thus the first negative-valued erasing signal is obtained. Accordingly, FIG. 9 is a schematic layout of a circuit device of scanning IC's 60 in accordance with the present invention. As shown in the drawing, the output of the circuit device of scanning IC's 60 is composed of a plurality of inverter circuits, of which the first inverter circuit comprises two transistors $H_1$ and $L_1$, wherein the transistor $L_1$ is connected in parallel with a diode. The first inverter circuit provides output display electrode signals such as $Y_1$, $Y_{41}$ and $Y_{81}$, etc. Similarly, the fortieth inverter circuit is composed of two transistors $H_{41}$ and $L_{40}$, and provides output display electrode signals such as $Y_{40}$, $Y_{80}$ and $Y_{120}$, etc. Analogically, the other inverter circuits provide the analogous set of output display electrode signals.

Figure 10:
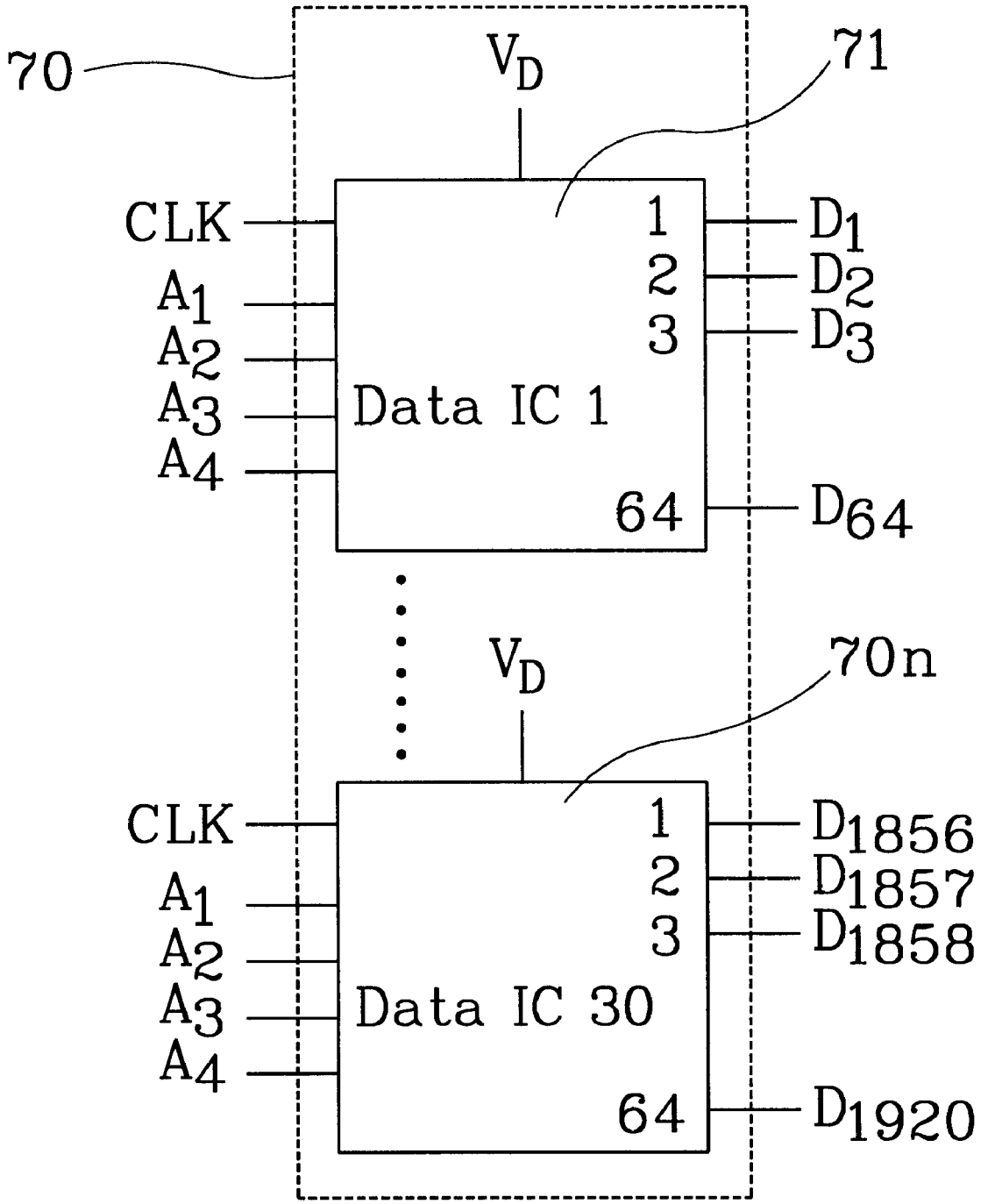
FIG. 10 is a schematic block diagram illustrating a circuit device of data IC's in accordance with the present invention.

The signal process circuit device of the present invention further comprises a plurality of data IC's. Referring to FIG. 10, which is a schematic block diagram illustrating a circuit device of data IC's in accordance with the present invention, let us take the circuit device comprising thirty data IC's as an example. It is composed of data IC's from the first one (labeled 71) to the thirtieth one (labeled 70*n*). The input of the first data IC 71 is composed of addressing signals $A_1$, $A_2$, $A_3$ and $A_4$ in associate with the clock signal CLK, and the output is composed of a plurality of data electrode signals from $D_1$ to $D_{64}$. Analogically, the thirtieth data IC provides the output data electrode signals from $D_{1856}$ to $D_{1920}$.

Referring to FIG. 10, as the previous discussion about the generation of the first negative-valued erasing signal, sixteen clock signals of the input data, namely, ($A_1$, $A_2$, $A_3$, $A_4$)=(1,0,1,0) are delivered to enable the output signals of the data electrodes. Furthermore, in the similar way as described in FIG. 8 and FIG. 9, when the transistor switch on the low voltage side of the even line display electrode is turned on, the input data ($A_1$, $A_2$, $A_3$, $A_4$) =(1,0,1,0) are delivered, and thus the second erasing signal is generated. For the first erasing signal, if A=(1,0,1,0 . . . 1,0) in total of 480 clock signals, then the data for the scanning IC's will be A=(0,1, 0,1 . . . 0,1) in total of 480 clock signals.

Figure 11:
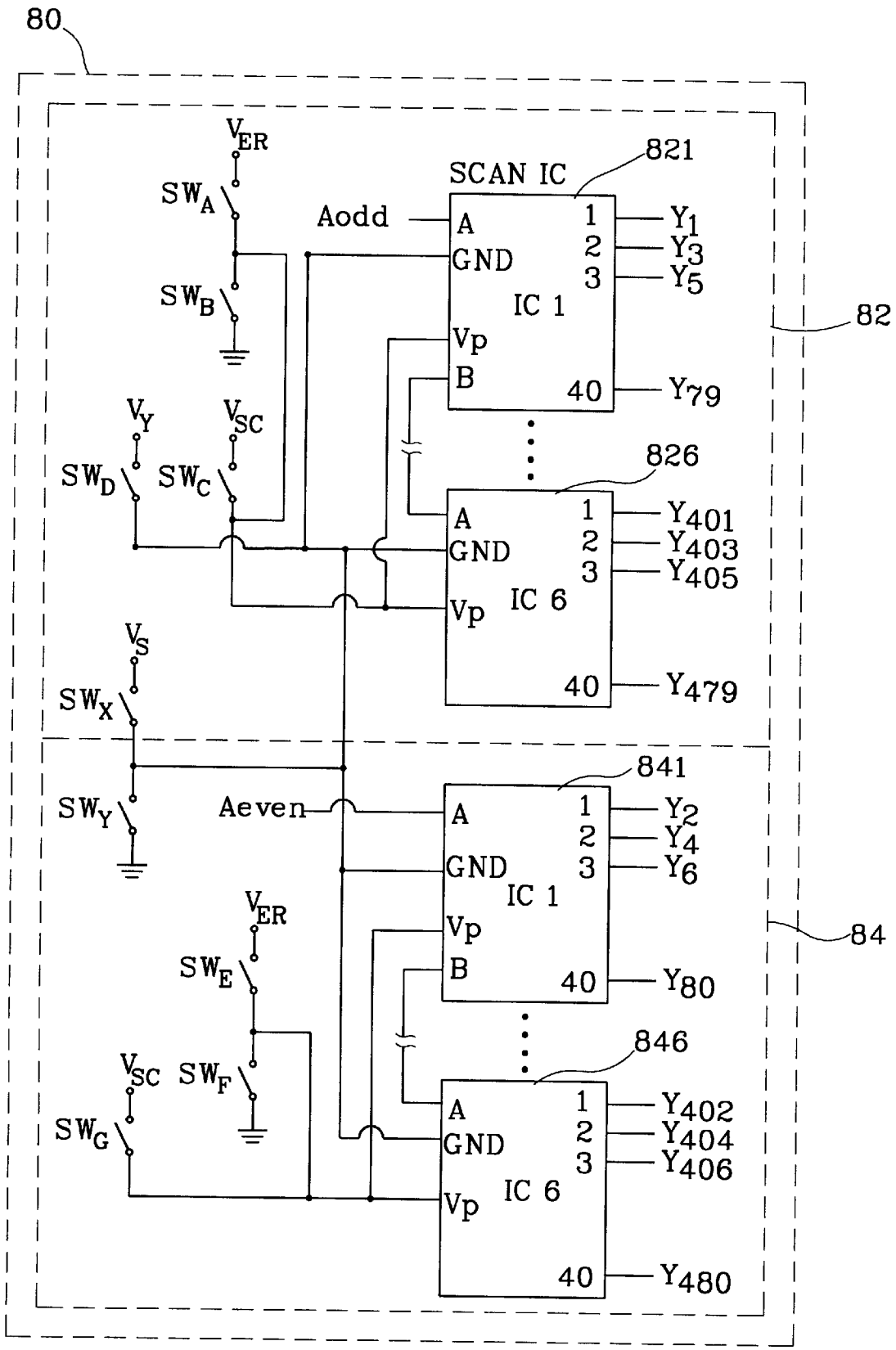
FIG. 11 is a schematic block diagram illustrating s signal scanning driver circuit device in accordance with the the present invention.

Please refer to FIG. 11, which is a schematic block diagram illustrating the signal scanning driver circuit in accordance with the present invention. As shown in the drawing, the circuit block is another schematic diagram of the embodiment as illustrated in FIG. 8. The circuit device of IC's for scanning drivers 80 is composed of a circuit device of IC's for scanning odd drivers 82 and a circuit device of IC's for scanning even drivers 84. The circuit device of IC's for scanning odd drivers 82 comprises six IC's from the first IC for odd scanning drivers 821 and the sixth IC for odd scanning drivers 826. In addition, the circuit device of IC's for scanning even drivers 84 comprises six IC's from the first IC for even scanning drivers 841 and the sixth IC for even scanning drivers 846. Referring to FIG. 11, each of the twelve IC's for scanning drivers is connected to transistor switches $SW_X$, $SW_Y$, $SW_A$ and $SW_B$. The circuit device of IC's for scanning odd drivers 82 is further connected to transistor switches $SW_C$ and $SW_D$, and the circuit device for IC's for scanning even drivers 84 is further connected to transistor switches $SW_E$ and $SW_F$. Consequently, the scanning IC's can execute the operation of selecting or enabling.

During the erasing signal period, the internal data of the circuit device of IC's for scanning drivers 80 is $A_{odd}$=(1,1,1 . . . 1) in total of two hundred and forty clock signals. After the transistor switch $SW_A$ is turned on, the waveform signal of the first erasing signal is obtained. Moreover, the data IC's can similarly receive the waveform that is required by the corresponding signal in the erasing signal. During the second erasing signal period, the even address signal of the circuit device of IC's for scanning drivers 80 is $A_{even}$=(1,1,1 . . . 1) in total of in total of two hundred and forty clock signals. After the transistor switch $SW_A$ is turned on, the waveform signal of the second erasing signal is obtained. Similarly, the data IC's can similarly receive the waveform that is required by the corresponding signal in the second erasing signal.

As discussed so far, the present invention relates to a driving method for reducing the dynamic image false contour for display panels, and more particularly, to a driving method in which the erase period of the driving pulse is separated. Furthermore, the present invention further provides a signal process circuit device of the driving method, which comprises a plurality of scanning IC's and a plurality of data IC's. The present invention can effectively reduce the dynamic false contour and improve the moving picture quality compared with the conventional method in the prior art. In other words, the present invention is progressive and has great potential in commercial applications.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A method for driving a plasma display panel having a first substrate, a second substrate facing said first substrate, a least two display lines formed on said first substrate and sequentially numbered as either one of an odd-numbered display line and an even-numbered display line, each of the display lines having a first electrode and a second electrode disposed in parallel with each other, and at least two third electrodes disposed on said second substrate and extending orthogonally to said first electrodes and said second electrodes for defining a cell among each set of first, second, and third electrode, said first electrode and said second electrode of said odd-numbered display line being defined as an odd-numbered first electrode and an odd-numbered second electrode respectively, said first electrode and said second electrode of said even-numbered display line being defined as an even-numbered first electrode and an even-numbered second electrode respectively, wherein said method comprising sequentially executed following steps:

(a) executing a first sustaining discharge for all cells of said odd-numbered and even-numbered display lines by alternatively applying driving signals on either one of said first electrodes and said second electrodes;

(b) executing a first erase discharge for a first group of cells of said even-numbered display line by applying a first erase signal on either one of said even-numbered first electrode and said even-numbered second electrode;

(c) executing a second erase discharge for a second group of cells of said odd-numbered display line by applying a second erase signal on either one of said odd-numbered first electrode and said odd-numbered second electrode; and (d) executing a second sustaining discharge for all cells of said odd-numbered and even-numbered display lines, except said first group and said second group of cells, by alternatively applying driving signals on either one of said first electrodes and said second electrodes.

2. A method for driving a plasma display panel as claimed in claim 1, wherein the third electrodes are sequentially numbered as either one of an odd-numbered third electrode and an even-numbered third electrode, and the first group of cells comprises the cells defined by said even-numbered display line and the even-numbered third electrode, and the second group of cells comprises the cells defined by said odd-numbered display line and the odd-numbered third electrode.

* * * * *